US006974918B2

(12) United States Patent
Blossfeld

(10) Patent No.: US 6,974,918 B2
(45) Date of Patent: Dec. 13, 2005

(54) ROCKER SWITCH

(75) Inventor: Mike Blossfeld, South Lyon, MI (US)

(73) Assignee: TRW Automotive U.S. LLC, Livonia, MI (US)

( * ) Notice: Subject to any disclaimer, the term of this patent is extended or adjusted under 35 U.S.C. 154(b) by 0 days.

(21) Appl. No.: 10/693,508

(22) Filed: Oct. 24, 2003

(65) Prior Publication Data

US 2005/0087429 A1 Apr. 28, 2005

(51) Int. Cl.[7] ..... H01H 9/00
(52) U.S. Cl. ..... 200/5 R; 200/553; 200/284; 200/292; 200/294; 200/295; 200/339
(58) Field of Search ..... 200/1 R, 1 B, 200/1 V, 5 R, 553, 557–559, 239, 244–246, 284, 292, 294–296, 303, 307, 339

(56) References Cited

U.S. PATENT DOCUMENTS

| | | | | | |
|---|---|---|---|---|---|
| 3,670,121 | A | | 6/1972 | Howe | 200/67 G |
| 3,809,838 | A | * | 5/1974 | Coppola | 200/532 |
| 4,336,431 | A | * | 6/1982 | Loose | 200/292 |
| 4,731,925 | A | * | 3/1988 | Tanishi et al. | 29/840 |
| 4,857,018 | A | | 8/1989 | Pickles | |
| 4,967,046 | A | | 10/1990 | Priesemuth | 200/339 |
| 5,149,924 | A | | 9/1992 | Priesemuth | 200/5 R |
| 5,598,918 | A | | 2/1997 | Malecke et al. | 200/558 |
| 5,833,048 | A | | 11/1998 | Dilly | 200/446 |
| 5,915,999 | A | | 6/1999 | Takenaka et al. | |
| 6,091,038 | A | | 7/2000 | Murphy et al. | 200/563 |
| 6,175,090 | B1 | * | 1/2001 | Blossfeld | 200/558 |
| 6,191,373 | B1 | * | 2/2001 | Liao | 200/16 A |
| 6,312,296 | B1 | | 11/2001 | Jones | |
| 6,596,956 | B1 | * | 7/2003 | Czarnecki | 200/552 |
| 6,600,122 | B1 | * | 7/2003 | Czarnecki et al. | 200/553 |

FOREIGN PATENT DOCUMENTS

| | | |
|---|---|---|
| DE | 3916944 | 11/1990 |
| DE | 4406200 | 3/1995 |
| EP | 0773568 | 5/1997 |
| WO | 95/00963 | 1/1995 |

* cited by examiner

*Primary Examiner*—Michael A. Friedhofer
(74) *Attorney, Agent, or Firm*—Tarolli, Sundheim, Covell & Tummino L.L.P.

(57) ABSTRACT

An apparatus (10) includes spaced contacts (40). A rocking contact (50) has first and second arms (52 and 54) in electrical contact with each other and is supported for rocking movement in opposite first and second directions. The first arm (52) is movable into engagement with a first one of the contacts (40) when the rocking contact (50) rocks in the first direction. The second arm (54) is movable into engagement with the second one of the contacts (40) when the rocking contact (50) rocks in the second direction. An actuator (32) is pivotable to effectuate rocking movement of the rocking contact (50) in the first and second directions. The first and second contacts (40) include respective terminals (70 and 76) for helping to mount the apparatus. The terminals (70 and 76) each comprise compliant pin connectors.

13 Claims, 8 Drawing Sheets

ROCKER SWITCH

TECHNICAL FIELD

The present invention relates to an electrical switch that incorporates the use of compliant connectors. In one embodiment, the present invention relates to a rocker switch.

BACKGROUND OF THE INVENTION

Switches for making and breaking electrical circuits are widely known. Manually operated switches include an actuator that is manually actuatable to cause making/breaking action of switch contacts to energize/de-energize one or more electrical circuits associated with the contacts. For example, vehicles with electric power devices, such as windows, may have a control system with several individual switches for controlling operation of the windows. Among these switches may be a rocker switch that has an actuator in the form of a lever actuatable to effectuate rocking movement of a contact

SUMMARY OF THE INVENTION

The present invention relates to an apparatus comprising first and second spaced contacts. A rocking contact has first and second arms in electrical contact with each other. The rocking contact is supported for rocking movement in opposite first and second directions. The first arm moves into engagement with the first contact when the rocking contact rocks in the first direction. The second arm moves into engagement with the second contact when the rocking contact rocks in the second direction. An actuator is pivotable to effectuate rocking movement of the rocking contact in the first and second directions. The first and second contacts each comprise a terminal for helping to mount the apparatus. The terminals each comprise a compliant pin connector.

The present invention also relates to an apparatus comprising an electric vehicle window motor operable in first and second rotational directions. A printed circuit board delivers electrical signals to the electric motor to cause the electric motor to rotate in the first and second rotational directions. A rocker switch is operable to switch electrical signals to the electric motor via the printed circuit board. The apparatus also includes means for connecting the rocker switch to the printed circuit board. The means consists essentially of compliant pin connectors of the rocker switch.

BRIEF DESCRIPTION OF THE DRAWINGS

The foregoing and other features of the invention will become more apparent to one skilled in the art upon consideration of the following description of the invention and the accompanying drawings in which.

DESCRIPTION OF EMBODIMENTS

Figure 1:
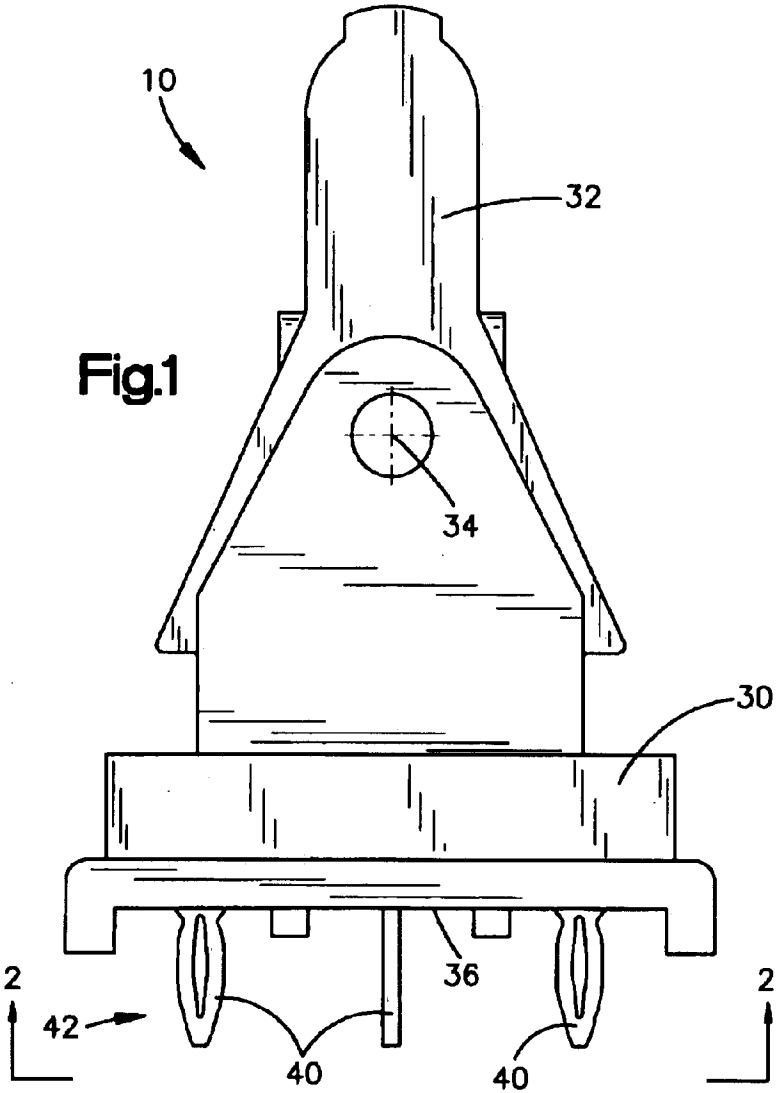
FIG. 1 is a side view of a rocker switch according to a first embodiment of the present invention.

The present invention relates to an electrical switch for controlling a device on a vehicle. The device may be any device on a vehicle, such as a window, a seat, a mirror, or the like. The specific embodiment of the invention described below relates to a power window. Those skilled in the art, however, will appreciate that the switch of the present invention may control a device other than a window.

The present invention is also applicable to various switch constructions. As representative of one such switch construction of the present invention, FIGS. 1–6C illustrate a rocker switch assembly 10 (hereinafter "rocker switch"). The rocker switch 10 is implemented in a system 12 (shown schematically in FIGS. 4A–6C) that includes an electric window motor 14 and a vehicle electrical system including an electrical power source in the form of a battery 16 and a ground 18. The rocker switch 10 controls operation of the electric motor 14 for raising and lowering a vehicle window (not shown). The electric motor 14 is capable of bi-directional rotation, i.e., a reversible motor, such as a DC motor. As will be described herein below, the rocker switch 10 of the present invention may provide "manual" control of the operation of the electric motor 14 (and thus the vehicle window), and may also provide some "automatic" control of the operation of the electric motor.

Figure 2:
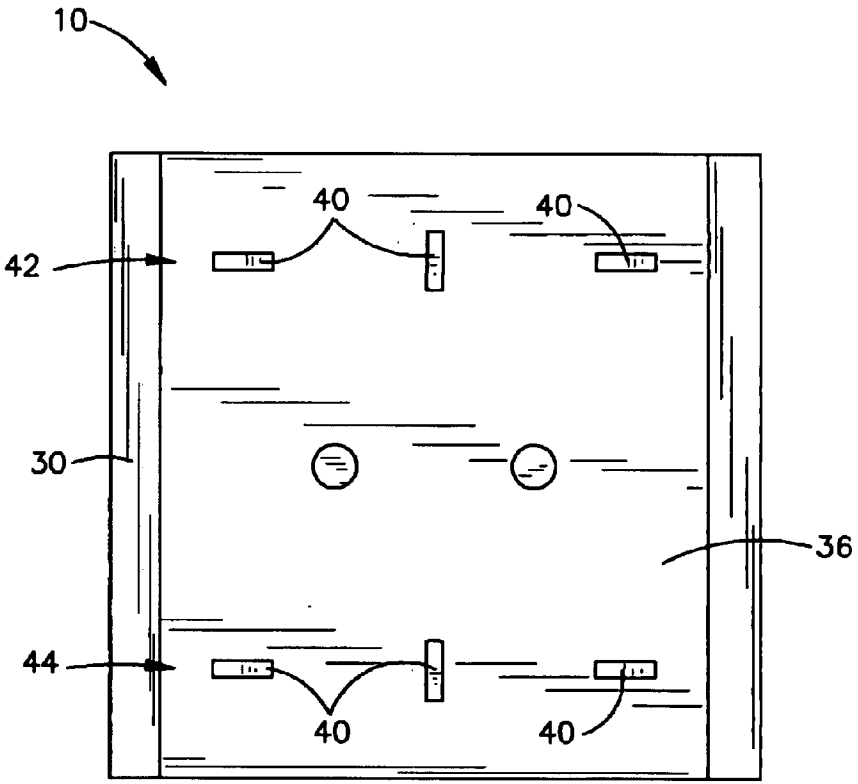
FIG. 2 is a bottom view of the rocker switch illustrated in FIG. 1.
Figure 3:
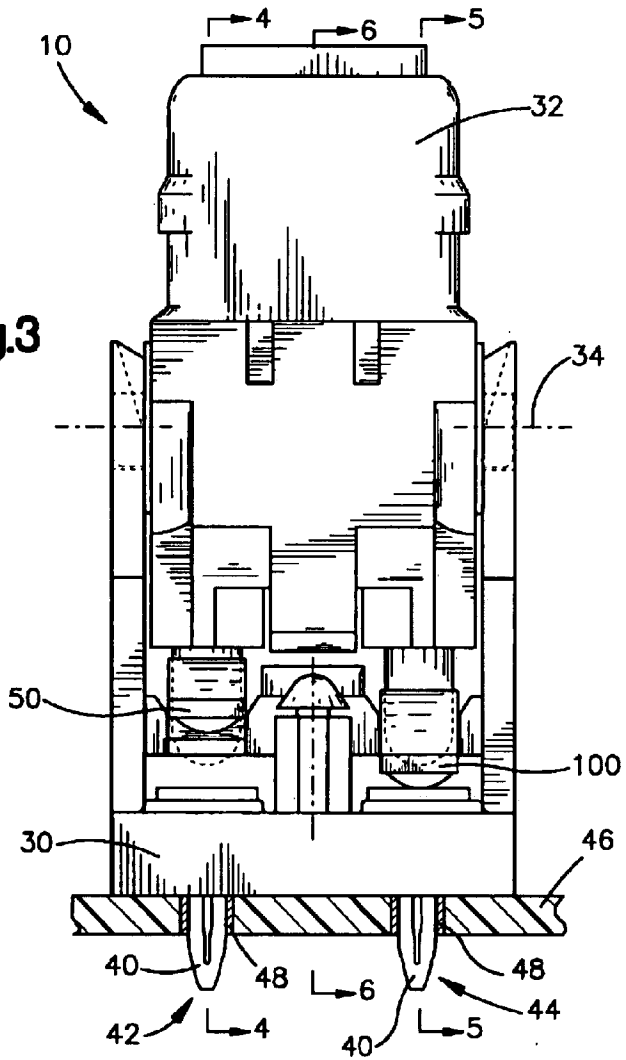
FIG. 3 is an end view of the rocker switch illustrated in FIG. 1.

Referring to FIGS. 1–3, the rocker switch 10 includes a base 30 that supports an actuator in the form of a lever 32 for pivotal or rotational movement about an axis 34. A series of terminals 40 protrude from a lower surface 36 of the base 30 of the rocker switch 10. In the illustrated embodiment, the rocker switch 10 includes six such terminals 40 arranged in first and second rows 42 and 44. The terminals 40 are for connecting the rocker switch 10 to plated-through holes 48 of a member 46 (see FIGS. 3–6C), such as a printed circuit board. The terminals 40 may thus carry electrical signals between the rocker switch 10 and the other portions of the system 12 via the printed circuit board 46, as will be described herein below.

Figure 4A:
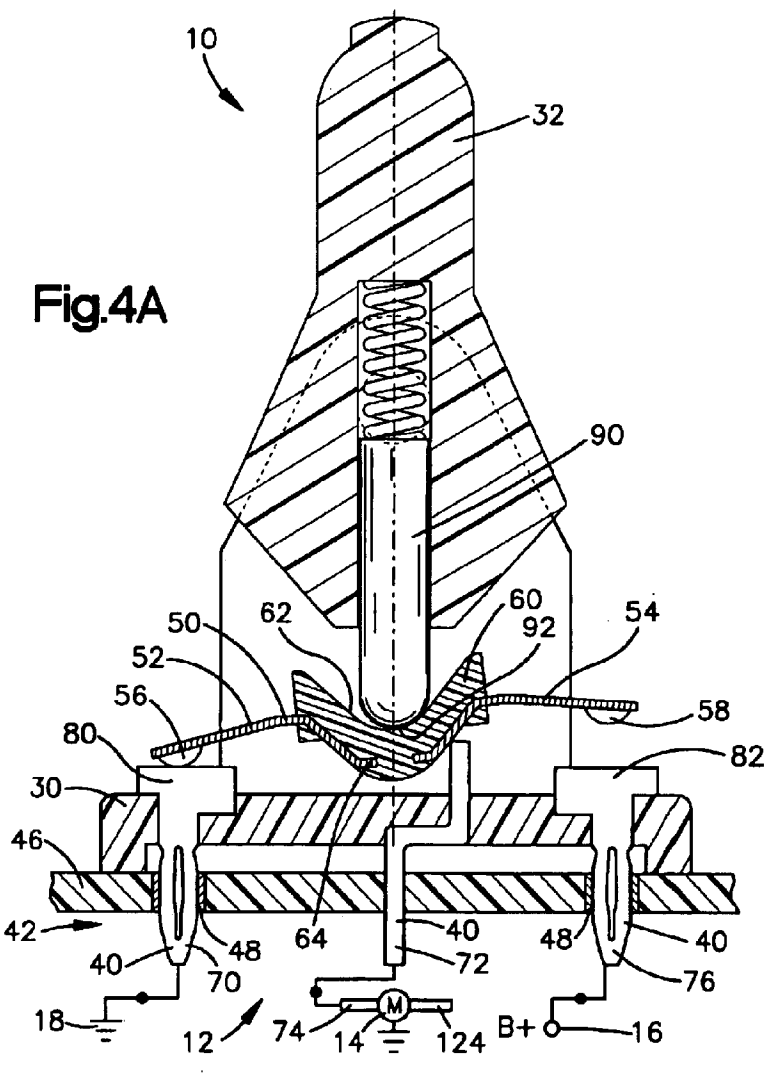
FIGS. 4A–4C are a sectional views taken generally along line 4—4 in FIG. 3, showing parts of the rocker switch in different positions.
Figure 4C:
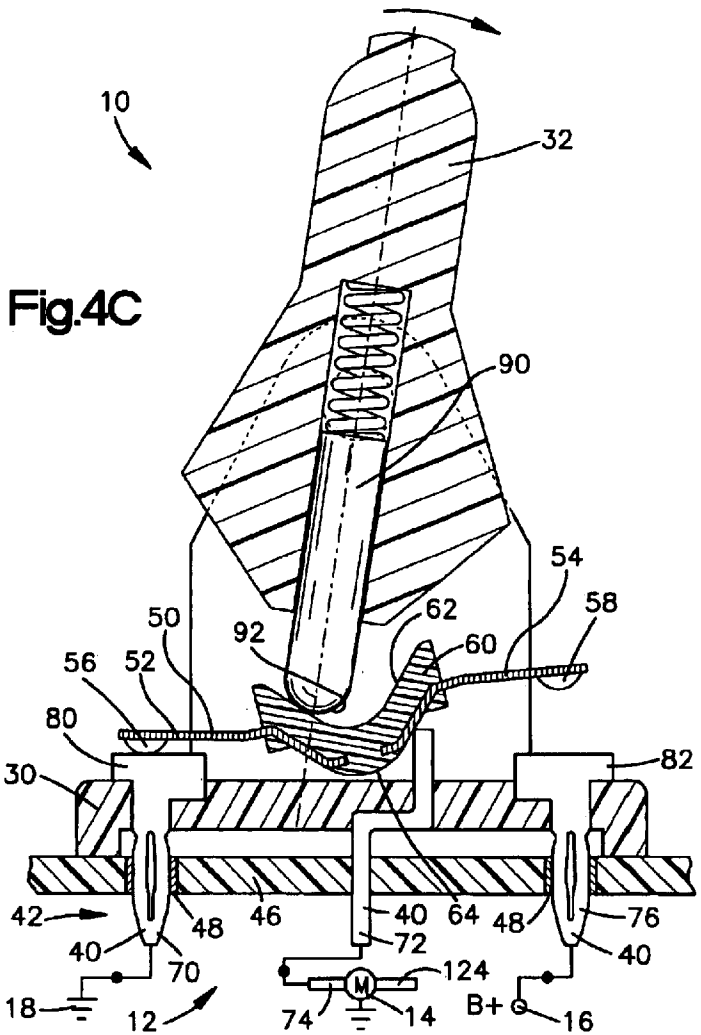
Figure 4B:
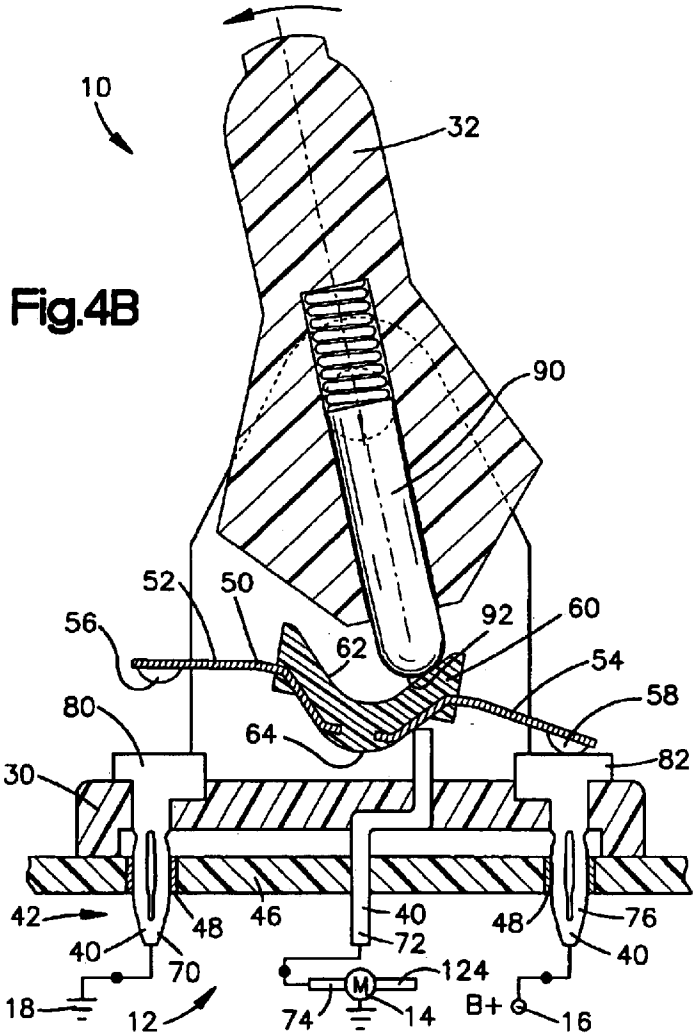

Referring to FIG. 3, the rocker switch 10 includes first and second switch members 50 and 100 associated with the first and second rows 42 and 44 of terminals 40, respectively. Referring to FIGS. 4A–4C, the first switch member 50 includes a first contact arm 52 and an opposite second contact arm 54. The first and second contact arms 52 and 54 are in electrical contact with each other and may, for example be formed of a single piece of metal material, such as copper or a copper alloy. The first and second contact arms 52 and 54 each may include a domed contact portion 56 and 58, respectively.

The first switch member 50 is supported by a body portion 60 that may be formed of a material, such as plastic. The first switch member 50 may thus be insert molded in the body portion 60. The body portion 60 includes an upper actuator surface 62 and an opposite lower rocker surface 64. The first and second contact arms 52 and 54 each have a portion exposed on the rocker surface 64 of the body portion 60.

As shown in FIGS. 4A–4C, the first switch member 50 is associated with the three terminals 40 in the first row 42.

Among these terminals are a terminal 70 connected to ground, a terminal 72 connected to a first directional input 74 of the motor 14, and a terminal 76 connected to the battery 18. The terminals 70, 72, and 76 are formed of an electrically conductive material, such as metal, and may be connected to the base 30 by suitable means, such as by insert molding or press fitting the terminals into the base. The ground terminal 70 includes a contact portion 80 presented toward the contact portion 56 of the first contact arm 52. The battery terminal 76 includes a contact portion 82 presented toward the contact portion 58 of the second contact arm 54.

The rocker surface 64 of the body portion 60 is supported by the base 30 of the rocker switch 10 and/or the motor terminal 72. In this configuration, the first switch member 50 is maintained in electrical contact with the motor terminal 72. A spring biased actuator pin 90 supported in the lever 32 has a domed end surface 92 that rides on the actuator surface 62 of the body portion 60 and helps maintain the body portion and first switch member 50 supported on the base 30 and/or motor terminal 72.

Figure 5C:
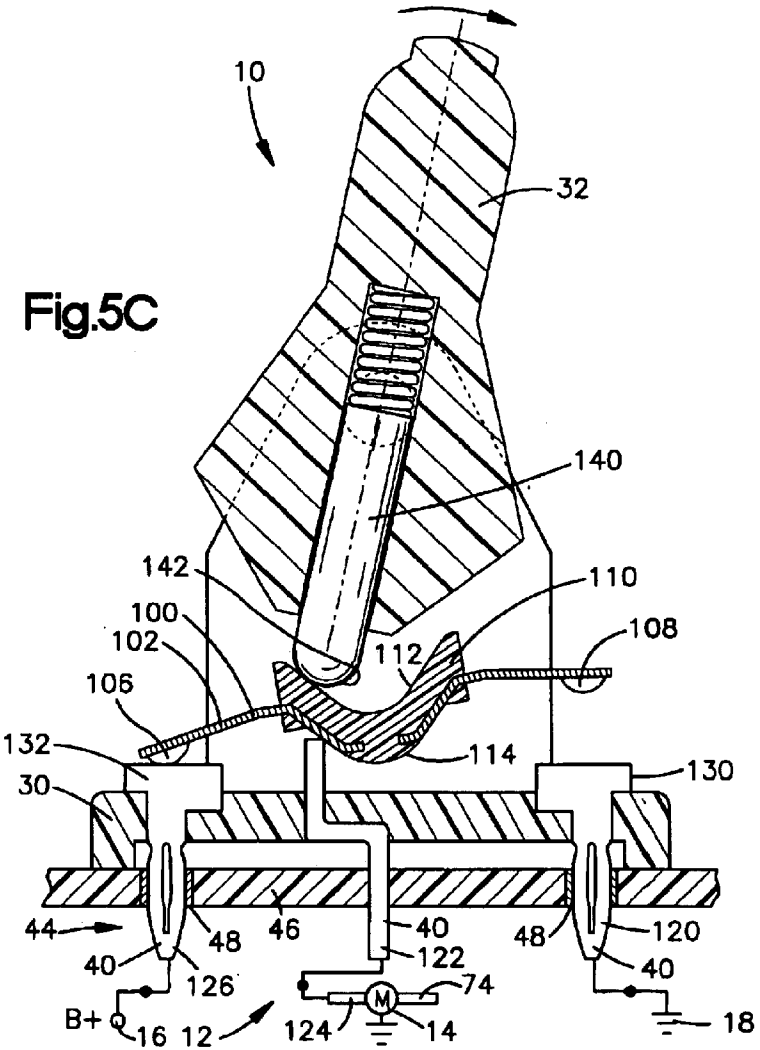
FIGS. 5A–5C are sectional views taken generally along line 5—5 in FIG. 3, showing parts of the rocker switch in different positions.
Figure 5A:
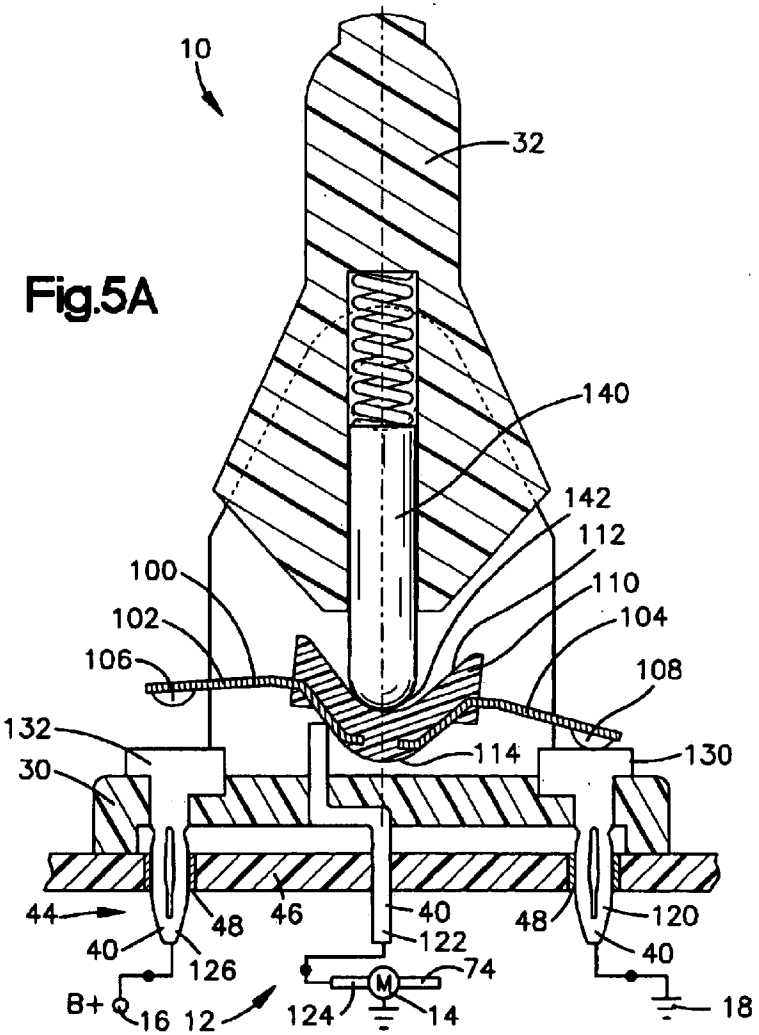
Figure 5B:
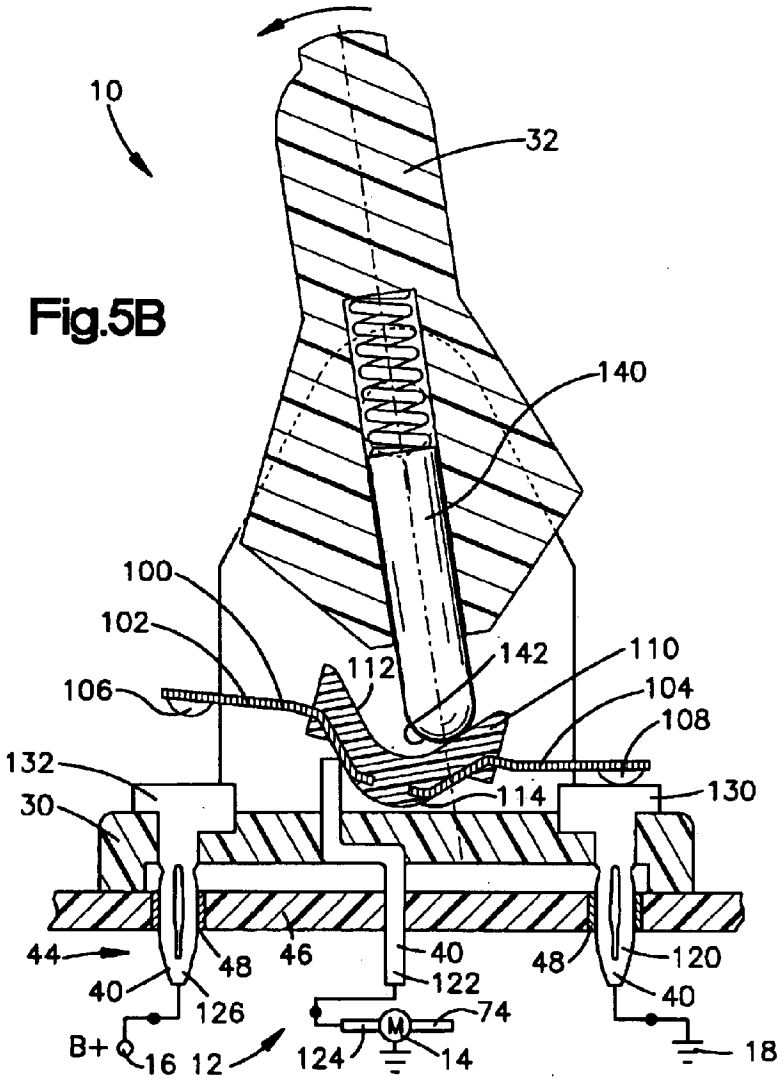

Referring to FIGS. 5A–5C, the second switch member 100 includes a first contact arm 102 and an opposite second contact arm 104. The first and second contact arms 102 and 104 are in electrical contact with each other and may, for example be formed of a single piece of metal material, such as copper or a copper alloy. The first and second contact arms 102 and 104 each may include domed contact portions 106 and 108, respectively.

The second switch member 100 is supported by a body portion 110 that may be formed of a material, such as plastic. The second switch member 100 may thus be insert molded in the body portion 110. The body portion 110 includes an upper actuator surface 112 and an opposite lower rocker surface 114. The first and second contact arms 102 and 104 each have a portion exposed on the rocker surface 114 of the body portion 110.

As shown in FIGS. 5A–5C, the second switch member 100 is associated with the three terminals 40 of the second row 44. Among these terminals 40 are a terminal 120 connected to ground, a terminal 122 connected to a second directional input 124 of the motor 14, and a terminal 126 connected to the battery 18. The terminals 120, 122, and 126 may be formed of an electrically conductive material and may be connected to the base 30 by suitable means, such as insert molding or press fitting the terminals into the base 30 of the rocker switch 10. The ground terminal 120 includes a contact portion 130 presented toward the contact portion 106 of the first contact arm 102. The battery terminal 126 includes a contact portion 132 presented toward the contact portion 108 of the second contact arm 104.

The rocker surface 114 of the body portion 110 is supported by the base 30 of the rocker switch 10 and/or the motor terminal 122. In this configuration, the second switch member 100 is maintained in electrical contact with the motor terminal 122. A spring biased actuator pin 140 supported in the lever 32 has a domed end surface 142 that rides on the actuator surface 112 of the body portion 110 and helps maintain the body portion and second switch member 100 supported on the base 30 and/or motor terminal 122.

Figure 6A:
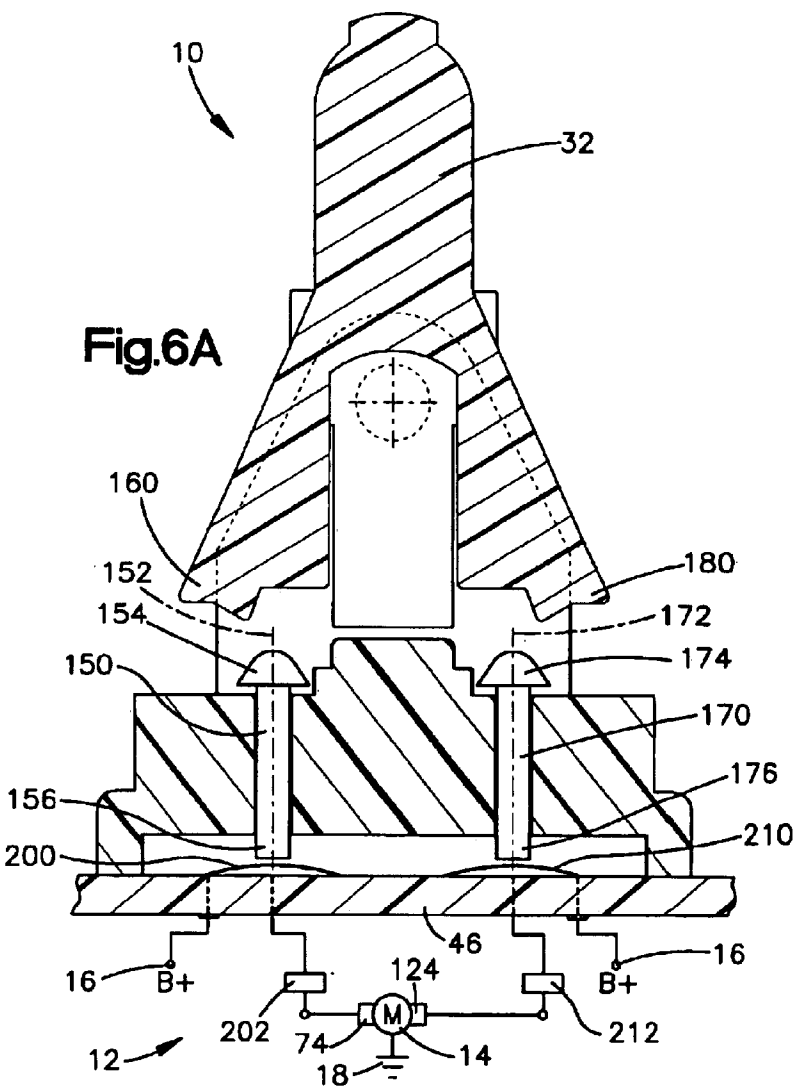
FIGS. 6A–6C are sectional views taken generally along line 6—6 in FIG. 3, showing parts of the rocker switch in different positions.
Figure 6C:
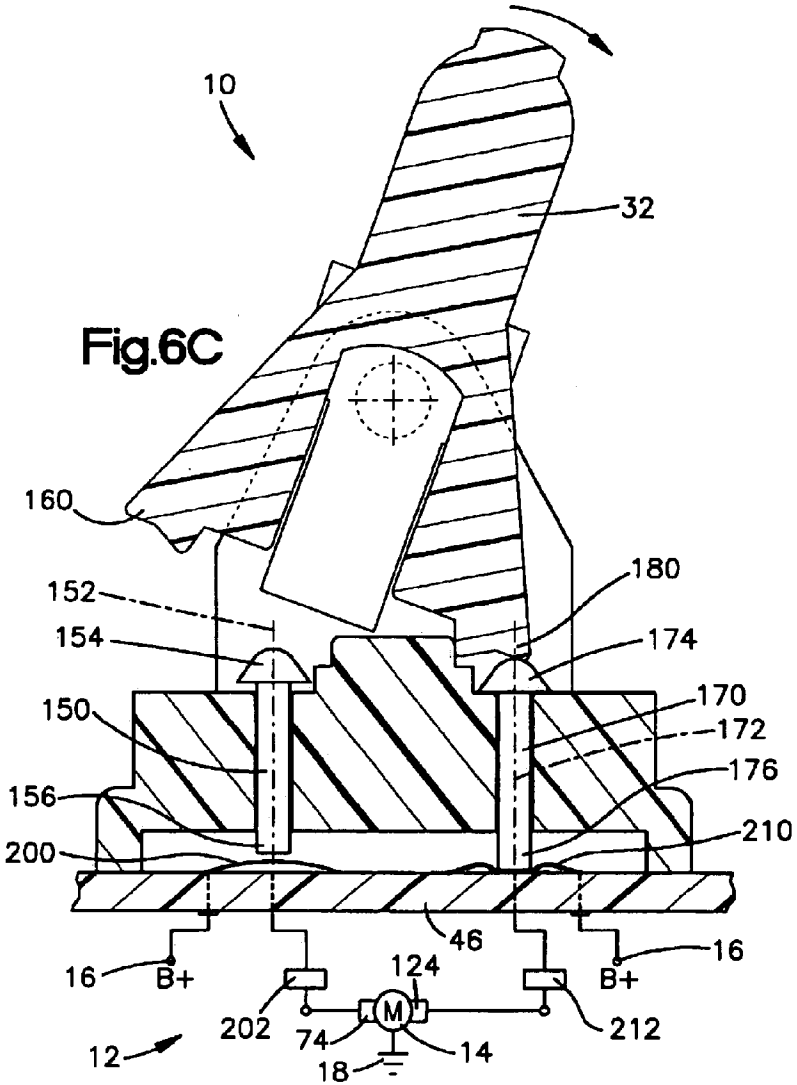
Figure 6B:
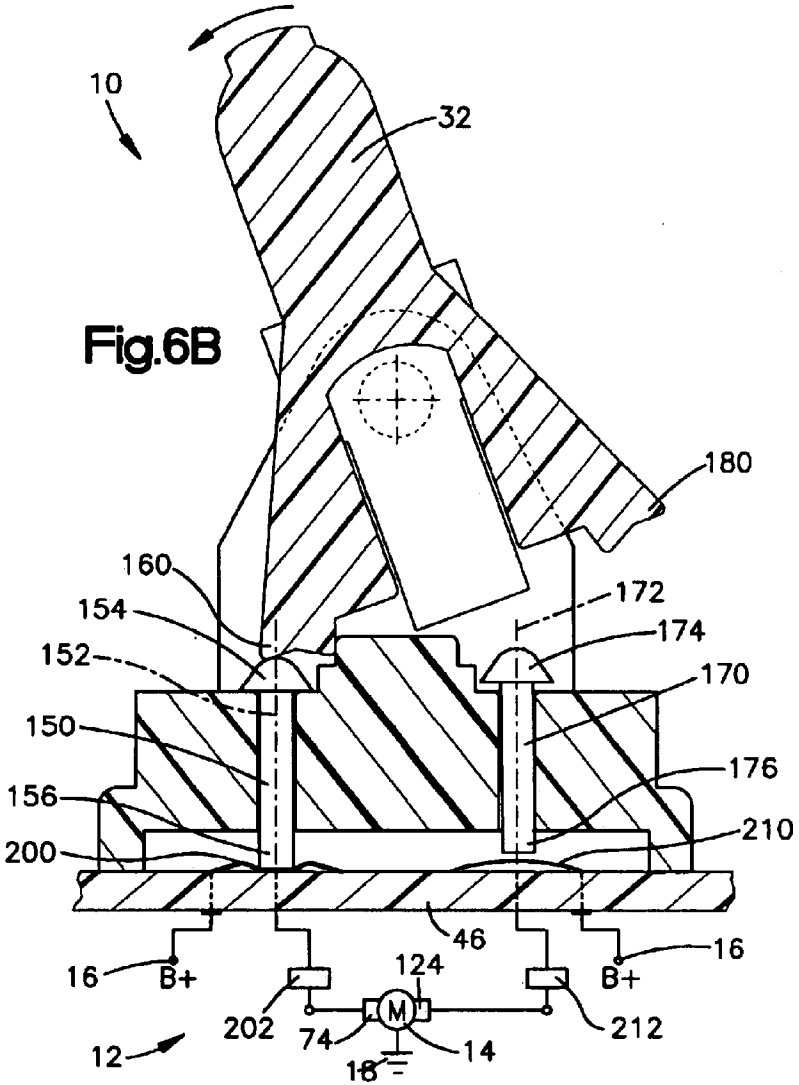

Referring to FIGS. 6A–6C, the rocker switch 10 may also include one or more actuator members. In the illustrated embodiment, the rocker switch 10 includes first and second actuator members 150 and 170, respectively. The lever 32 includes first and second actuator arms 160 and 180 associated with the first and second actuator members 150 and 170, respectively.

The first actuator member 150 is supported by the base 30 for axial movement along an axis 152. The first actuator member 150 has a domed actuator end 154 presented toward the first actuator arm 160 of the lever 32 and an opposite actuator end 156 that protrudes from the lower surface 36 of the base 30. The first actuator member 150 may be biased by means (not shown) such as a spring to an up or non-actuated position illustrated in FIGS. 6A and 6C.

The second actuator member 170 is supported by the base 30 for axial movement along an axis 172. The second actuator member 170 has a domed actuator end 174 presented toward the second actuator arm of the lever 32 and an opposite actuator end 176 that protrudes from the lower surface 36 of the base 30. The second actuator member 170 may be biased by means (not shown) such as a spring to an up or non-actuated position illustrated in FIGS. 6A and 6B.

Referring to FIGS. 4A–4C, the first switch member 50 is maintained in contact with the motor terminal 72 regardless of the position of the lever 32. Electrical conductivity is thus maintained between the first directional input 74 of the motor 14 and the first switch member 50 regardless of the position of the lever 32. As shown in FIG. 4A, when the lever 32 is in a non-actuated central or neutral position, the first directional input 74 of the motor 14 is connected to ground 18 via the first contact arm 52 and the ground terminal 70. This prevents the motor 14 from being energized to run in a first rotational direction associated with the first directional input 74.

If the lever 32 is actuated in a counterclockwise direction as shown in FIG. 4B, the actuator pin 90, riding on the actuator surface 62, urges the first switch member 50 to rock clockwise such that the contact portion 58 of the second contact arm 54 engages the contact portion 82 of the battery terminal 76. In this first actuated condition, voltage from the battery 16 is supplied to the first directional input 74 of the motor 14, which energizes the motor to run in the first rotational direction. This may result in the vehicle window (not shown) raising or lowering, depending on the wiring configuration of the system 12. For purposes of this description, it will be assumed that the window lowers when the motor 14 runs in the first rotational direction.

If the lever 32 is actuated in a clockwise direction as shown in FIG. 4C, the actuator pin 90, riding on the actuator surface 62, urges the first switch member 50 to rock counterclockwise such that the contact portion 56 of the first contact arm 52 engages the contact portion 80 of the ground terminal 70. In this second actuated condition, the first directional input 74 of the motor 14 is connected to ground 18. This prevents the motor 14 from being energized to run in the first rotational direction.

Referring to FIGS. 5A–5C, the second switch member 100 is maintained in contact with the motor terminal 122 regardless of the position of the lever 32. Electrical conductivity is thus maintained between the second directional input 124 of the motor 14 and the second switch member 100 regardless of the position of the lever 32. As shown in FIG. 5A, when the lever 32 is in the non-actuated position, the second directional input 124 of the motor 14 is connected to ground 18 via the second contact arm 104 and the ground terminal 120. This prevents the motor 14 from being energized to run in a second rotational direction associated with the second directional input 124.

If the lever 32 is actuated in a counterclockwise direction to the first actuated condition of the rocker switch 10 as shown in FIG. 5B, the actuator pin 140, riding on the actuator surface 112, urges the second switch member 100 to rock clockwise such that the contact portion 108 of the second contact arm 104 engages the contact portion 130 of the ground terminal 120. Thus, in the first actuated condition, the second directional input 124 of the motor 14 is connected to ground 18. This prevents the motor 14 from being energized to run in the second rotational direction.

If the lever 32 is actuated in a clockwise direction to the second actuated condition as shown in FIG. 5C, the actuator pin 140, riding on the actuator surface 112, urges the second switch member 100 to rock counterclockwise such that the contact portion 106 of the first contact arm 102 engages the contact portion 132 of the battery terminal 126. In this second actuated condition, voltage from the battery 16 is supplied to the second directional input 124 of the motor 14, which causes the motor to run in the second rotational direction. As a result, the vehicle window (not shown) would raise.

Referring to FIGS. 6A–6C, the system 12 may include first and second devices, 200 an 210, respectively, such as dome switches, that are mounted or otherwise associated with the circuit board 46. The first dome switch 200 is actuatable to switch electrical power from the vehicle battery 18 to a first auto-lower circuit 202, which is electrically connected to the first directional input 74 of the motor 14. The second dome switch 210 is actuatable to switch electrical power from the vehicle battery 18 to an auto-raise circuit 212, which is electrically connected to the second directional input 124 of the motor 14.

As shown in FIG. 6A, when the lever 32 is in the non-actuated position, the first and second dome switches 200 and 210 remain in the non-actuated condition. Thus, when the lever 32 is in the non-actuated position, the auto-lower circuit 202 and the auto-raise circuit 212 remain in a non-actuated or non-energized condition.

If the lever 32 is actuated in a counterclockwise direction beyond the first actuated condition as shown in FIG. 6B, the first actuator arm 160 of the lever 32 engages the first actuator member 150 and urges the first actuator member in a downward direction along the axis 152. If the lever 32 is actuated a predetermined distance in the counterclockwise direction, the first actuator member 150 will actuate the first dome switch 200 and thus energize the auto-lower circuit 202.

Once energized, the auto-lower circuit 202 is operative to energize the first directional input 74 of the motor 14 to cause the window to lower automatically to a fully-lowered, i.e., open position. Once energized, the auto-lower circuit 202 is sealed in the energized state until the command is canceled either via a manual command (i.e., by actuating the lever 32 in the clockwise direction) or via an internal cancel triggered by means, such as a motor current sensor, motor torque sensor, or limit switch (not shown).

If the lever 32 is actuated in a clockwise direction beyond the second actuated condition as shown in FIG. 6C, the second actuator arm 180 of the lever 32 engages the second actuator member 170 and urges the second actuator member in a downward direction along the axis 172. If the lever 32 is actuated a predetermined distance in the counterclockwise direction, the second actuator member 170 will actuate the second dome switch 210 and thus energize the auto-raise circuit 212.

Once energized, the auto-raise circuit 212 is operative to energize the second directional input 124 of the motor 14 to cause the window to raise automatically to a fully-raised, i.e., closed position. Once energized, the auto-raise circuit 212 is sealed in the energized state until the command is canceled either via a manual command (i.e., by actuating the lever 32 in the counterclockwise direction) or via an internal cancel triggered by means, such as a motor current sensor, motor torque sensor, or limit switch.

Figure 7B:
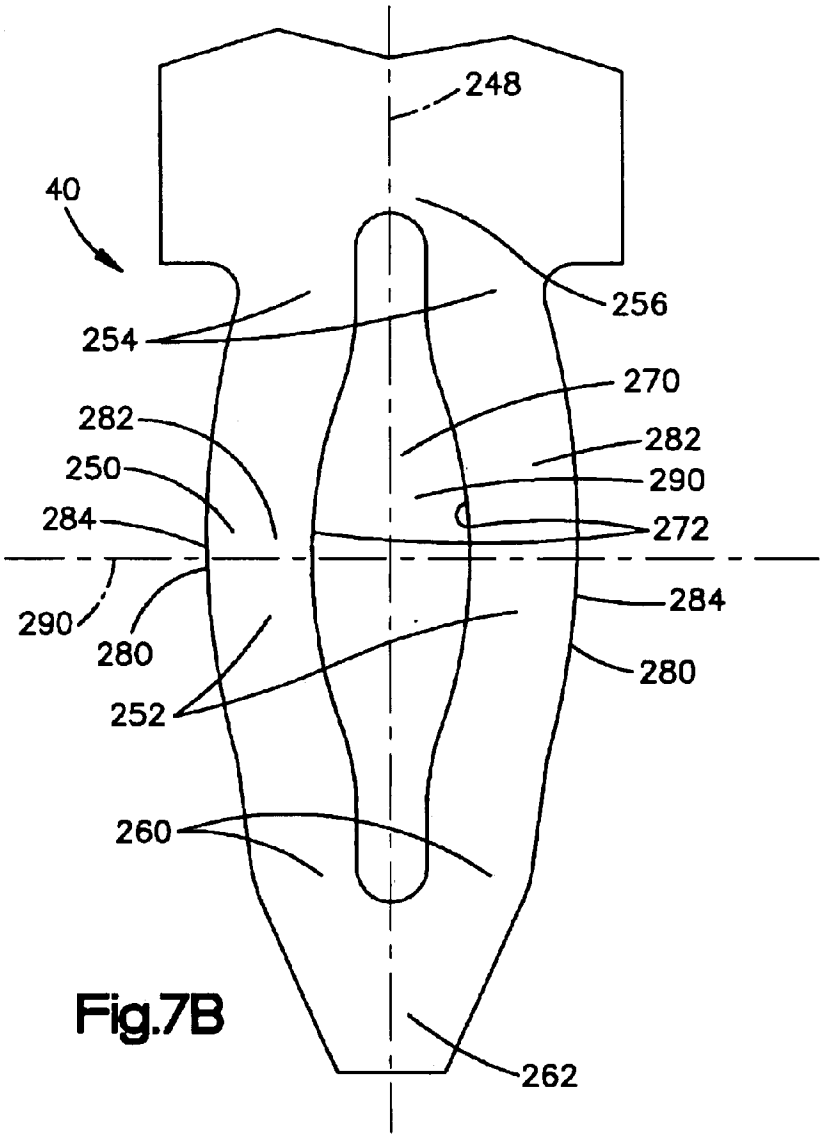
FIGS. 7A and 7B are side views of portions of the rocker switch of FIGS. 1–5.
Figure 7A:
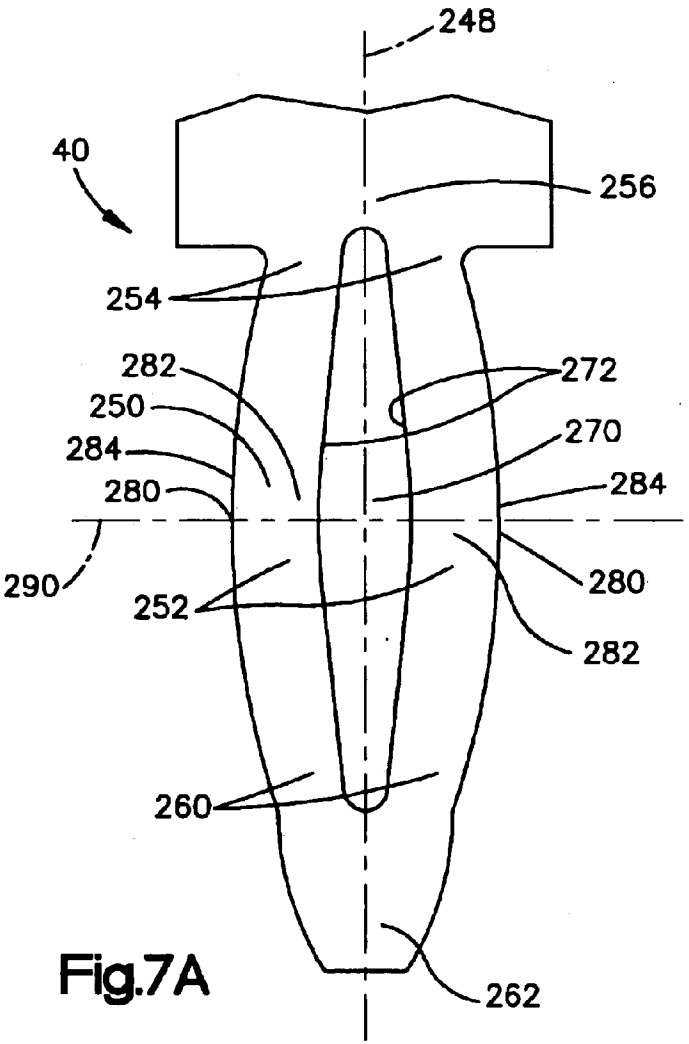

According to the present invention, each of the terminals 40 comprises what may be referred to as a compliant connector pin or a compliant pin. Compliant pins are given this name because they deflect, deform, or otherwise comply with a hole or aperture into which they are press-fitted in order to form an interference fit. This interference fit helps connect the compliant pin to a member in which the hole or aperture extends. The terminals 40 may have a variety of compliant pin configurations. By way of example, two such compliant pin configurations are illustrated in FIGS. 7A and 7B. Each terminal 40 of the rocker switch 10 may be formed according to either of the compliant pin configurations illustrated in FIGS. 7A and 7B.

Referring to FIGS. 7A and 7B, the compliant pin portion 250 of the terminal 40 may include a pair of spaced beam portions 252. As shown in FIG. 7A, the beam portions 252 may be spaced symmetrically with respect to an axis 248 of the pin portion 250. The beam portions 252 each have first end portions 254 that merge with each other at an interface end 256 of the pin portion 250. The interface end 256 merges with the respective portions of the terminals 40 that are secured to the base 30 of the rocker switch 10 (see FIGS. 4A–5C). The beam portions 252 each have second end portions 260, opposite the first end portions 254, that merge with each other at terminal insertion end 262 of the pin portion 250. The pin portion 250 includes a central opening 270 that is defined by opposing inner surfaces 272 of the beam portions 252. The inner surfaces 272 may have a variety of configurations or contours, such as straight, flat, curved, and cylindrical.

The beam portions 252 each include an outer surface 280 that are presented facing outward, that is, away from each other and away from the axis 248. The outer surfaces 280 help define an outer surface of the pin portion 250. The outer surfaces 280 may include a combination of cylindrical, flat, or curved surfaces that are blended or intersect each other to form an outer contour of the pin portion 250. In the embodiments of both FIGS. 7A and 7B, the contour of the pin portion 250 is such that the interface end 256 and insertion end 262 have a narrowed or tapered configuration. The pin portion 250 tapers outward from the axis 248 or widens between the interface end 256 and insertion end 262.

The pin portion 250 has an interface portion 282 that includes respective portions of the beam portions 252. The interface portion 282 includes an interface surface 284 of each of the outer surfaces 280 of the beam portions 252. The interface surfaces 284 include the widest portion of the pin portion 250 as measured along a lateral axis 290 of the pin portion, which extends perpendicular to the longitudinal axis 248. The interface surfaces 284 are rounded, curved, or cylindrical in the region of the lateral axis 290 and merge with an insertion surface 286 that extends along the insertion end 262 of the pin portion 250. As shown in FIG. 7A, the interface portion 282 of the pin portion 250 may include portions of each of the beam portions 252 that are widened in comparison with the remainder of the beam portions.

The electrically conductive material used to construct the terminals 40 may be a metal alloy. The contact 10 may, for example, be stamped from a metal alloy sheet stock material using a die that is cut to form the desired configuration. The metal sheet stock material may, for example, be a copper alloy, such as a tin-brass alloy or phosphor-bronze alloy, or could be alloys of other metals, such as stainless steel. These metals may be tempered or otherwise treated to provide desired qualities, such as hardness, tensile strength, and yield strength, and may also be coated or otherwise treated to provide corrosion resistance.

Figure 8A:
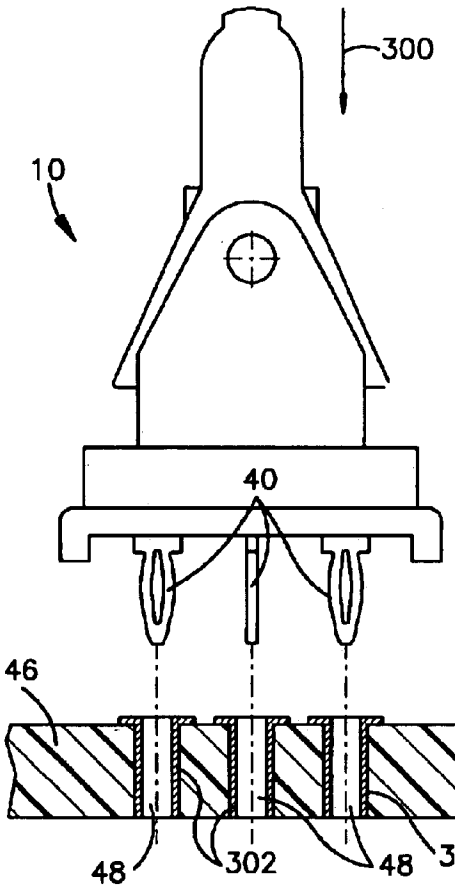
FIGS. 8A–8C are magnified elevation views illustrating the installation of the rocker switch.
Figure 8B:
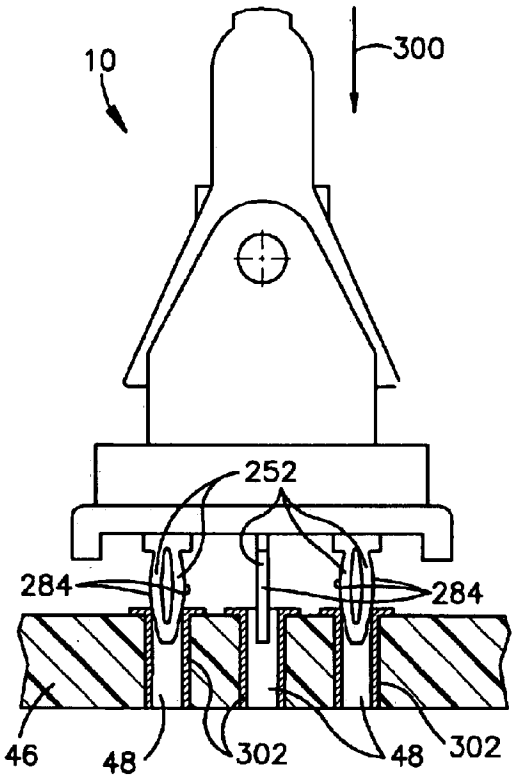
Figure 8C:
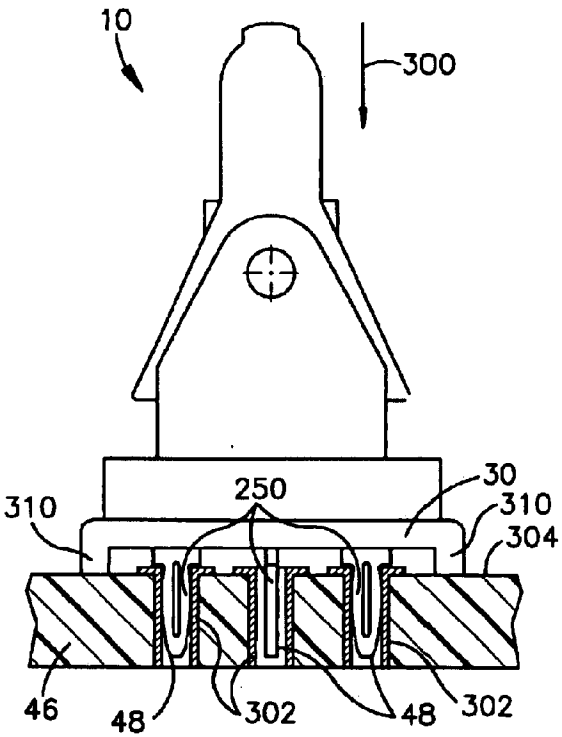

As a result of the compliant pin construction of the terminals 40, the rocker switch 10 of the present invention may be installed in a quick and reliable manner without the use of solder or other materials, such as adhesives or fasteners. This is shown in FIGS. 8A–8C. Referring to FIG. 8A, the rocker switch 10 is positioned with the terminals 40 presented toward the printed circuit board 46. The rocker switch 10 is directed in a downward direction indicated generally by the arrow labeled 300 toward the plated through-holes 48 in the circuit board 14. Each of the through-holes 48 has a side wall 302 that is plated, coated, or otherwise formed with an electrically conductive material (e.g., copper, silver, gold, nickel; tin-lead, or combinations or alloys thereof).

Referring to FIG. 8B, as the rocker switch 10 moves in the downward direction 300, the interface surfaces 284 of the beam portions 252 engage the printed circuit board 46. More specifically, the interface surfaces 284 of the beam portions 252 engage diametrically opposite locations on the side wall 302 of the through-hole 48 adjacent the intersection of the side wall and an upper surface 304 of the circuit board 46. As shown in FIG. 8B, the interface portions 282 of the pin portion 250 form an interference with the through-hole 48. More specifically, an interference is formed between the interface surfaces 284 of the beam portions 252 and the side wall 302.

Referring to FIG. 8C, as the rocker switch 10 moves farther in the downward direction 300, the beams 252 are urged toward each other as a result of normal forces exerted on the interface portions 282 by the side wall 302 of the through-hole 48. As the pin portion 250 enters the through-hole 48, the beam portions 252 deflect toward each other in a direction generally along the lateral axis 290. Also, as the rocker switch 10 moves farther in the downward direction 300, the interface surfaces 284 of the beam portions 252 slide past the intersection of the side wall 302 and the upper surface 304 of the printed circuit board 46. Once the interface portions 282 enter the through-hole 48, the interface surfaces 284 slide along the side wall 302.

When the beam portions 252 deflect as a result of the pin portion 250 being inserted into the through-hole 48, they exert a force on the side wall 302. This force is caused by the resilience of the material used to construct the terminals 40. The material construction of the terminals 40 causes the beam portions 252, when deflected toward each other, to have a spring bias that urges the beam portions away from each other and toward the side wall 302. Thus, when the terminals 40 are inserted into the through-hole 48 and the beam portions 252 are urged toward each other, the beam portions are biased in an opposite direction into engagement with the side wall 302 of the through-hole 48. This causes a frictional engagement between the interface surfaces 284 of the beam portions 252 and the side wall 302. Since the side wall 302 may be plated or otherwise coated with an electrically conductive material, this engagement may also result in an electrically conductive connection between the terminals 40 and their respective side walls and thereby between any devices (e.g., the motor 14) connected with the rocker switch 10 via the circuit board 46.

As the pin portion 250 is urged into the through-hole 48, the side wall 302 may also be deformed as the interfaces portions 282 cut into or gouge the electrically conductive material of the side wall. This deformation may help promote or enhance the frictional engagement between the interface portions 282 and the side wall 302. It will be appreciated that the amount of frictional engagement between the beam portions 252 and the side wall 302 can be adjusted to desired levels by altering the material construction of the terminals 40 and/or the side wall, by altering the amount of interference between the interface portions 282 and the side wall, and also by altering the configuration of the compliant pin portion 250.

As the terminals 40 are moved in the downward direction 300 into the installed condition of FIG. 8C, leg portions 310 of the base 30 engage the upper surface 304 of the circuit board 46. This helps prevent over-insertion of the terminals 40 into their respective through-holes 48. This also helps ensure that the rocker switch 10 is placed in a desired position relative to the circuit board 46 when in the installed condition. This may, for example, help place the first and second actuator members 150 and 170 in a desired position relative to the first and second dome switches 200 and 210 (see FIGS. 6A–6C).

In helping to position the rocker switch 10 relative to the circuit board 46, the leg portions 310 also help determine and maintain the axial position of the pin portion 250 in the through-hole 48 when fully inserted. More specifically, this helps to limit insertion of the pin portions 250 in the through-holes 48 and thereby helps determine the axial position of the pin portions when fully inserted in the through-hole 48. The frictional engagement between the pin portions 250 and the side walls 302 helps provide a retention force that helps retain the terminals 40 and, thus, the rocker switch 10 in the installed condition with the leg portions 310 positioned against the circuit board 46.

"Retention force" refers to the degree to which the frictional engagement between the pin portion 250 (i.e., the interface portions 282) and the side wall 302 prevents removal of the contact terminals 40 once fully inserted in the through-holes 48. To measure the retention force exhibited by the terminals 40, a measurement is made as to the amount of force, applied to any one of the terminals in a direction generally parallel to the axis 248 (see FIGS. 7A and 7B), that is required to remove the terminal from the through-hole 48 once the terminal is fully inserted in the through-hole. "Insertion force" refers to the amount of force required to insert one of the pin portions 250 in the through-hole 48.

The pin portions 250 of the terminals 40 have a thickness that is measured perpendicular to the axes 248 and 290. The configuration of the pin portion 250 of the terminal 40, the material construction of the terminal, the construction of the through hole 48, and the interference between the through hole and the pin portion all help determine the insertion and retention forces for the pin portion.

For example, the configuration of the pin portions 250 illustrated in FIGS. 7A and 7B may be constructed of an ASTM Specification No. B591 tin-brass copper alloy. This alloy may have the following composition: 88.0–91.0% copper, 1.5–3.0% tin, 0.05–0.20% nickel, 0.05–0.20% iron, 0.01–0.20% phosphorous, and the remainder zinc and no more than 0.05% lead. An ASTM B591 alloy having this composition is commercially available from the Olin Corporation of Norwalk, Conn., which markets the alloy as Olin Alloy No. 4252. With a spring hardened temper, this alloy has a tensile strength of 95–110 ksi, a nominal yield strength of 100 ksi, and a nominal elongation of 4%.

In the configuration of FIG. 7A, the pin portion 250 may have, for example, a thickness of about 0.64 millimeters.

The width of the pin portion 250 of FIG. 7A measured between the outer surfaces 284 at the widest point on the pin portion may be about 1.19 millimeters. The side wall 302 of the through hole 48 may have an inner diameter of about 1.01 millimeters. In this configuration and constructed with the ASTM B591 material set forth above, the terminal 40 may have an insertion force of about 9.3–19.5 pounds and a retention force of about 8.9–15.6 pounds, depending on the plating of the through hole 48. More specifically, for a tin-lead and HASL plated through hole 48, the terminal 40 may have an insertion force of about 12.7–15.4 pounds and a retention force of about 11.7–13.2 pounds. For a tin-lead and gold/nickel electroplated through hole 48, the terminal 40 may have an insertion force of about 10.0–16.9 pounds and a retention force of about 10.2–13.6 pounds. For a tin-lead and gold/nickel electroless immersion plated through hole 48, the terminal 40 may have an insertion force of about 9.3–13.9 pounds and a retention force of about 8.9–12.1 pounds. For a tin-lead and silver electroless immersion plated through hole 48, the terminal 40 may have an insertion force of about 11.5–19.5 pounds and a retention force of about 12.2–15.6 pounds.

From the above description of the invention, those skilled in the art will perceive improvements, changes and modifications. For example, the rocker switch illustrated includes both auto-raise and auto-lower functionality. It will be appreciated, however, that the rocker switch could be configured to include only one auto function, such as auto-lower only. Such improvements, changes and modifications within the skill of the art are intended to be covered by the appended claims.

Having described the invention, the following is claimed:

1. Apparatus comprising:

first and second spaced contacts;

a rocking contact having first and second arms in electrical contact with each other, said rocking contact being supported for rocking movement in opposite first and second directions, said first arm moving into engagement with said first contact when said rocking contact rocks in said first direction, said second arm moving into engagement with said second contact when said rocking contact rocks in said second direction; and an actuator pivotable to effectuate rocking movement of said rocking contact in said first and second directions;

said first and second contacts each comprising a terminal for helping to mount said apparatus, said terminals each comprising a compliant pin connector for providing a solderless electrical connection.

2. The apparatus recited in claim 1, further comprising a third contact maintained in continuous engagement with said rocking contact, said rocking contact providing electrical contact between said first and third contacts when said first arm moves into engagement with said first contact, said rocking contact providing electrical contact between said second and third contacts when said second arm moves into engagement with said second contact, said third contact comprising a terminal for helping to mount said apparatus, said terminal comprising a compliant pin connector.

3. The apparatus recited in claim 2, further comprising a base for supporting said rocking contact, said actuator, and said first, second, and third contacts, said terminals of said first, second, and third contacts protruding from a lower surface of said base.

4. The apparatus recited in claim 2, wherein at least one of said compliant pin portions is insertable into a through-hole of a circuit board, said through-hole having a plated side wall, said one of said compliant pin portions comprising spaced deflectable beam portions having outer surfaces spaced apart a distance greater than the spacing of the opposing surfaces of the side wall, said beam portions engaging the side wall and deflecting toward each other and thus providing a frictional engagement between said beam portions and the side wall when said one of said compliant pin portions is inserted in the through-hole, the frictional engagement providing a retention force for retaining said one of said compliant pin portions in the through-hole and thereby helping to connect said apparatus to the circuit board.

5. The apparatus recited in claim 4, wherein said one of said compliant pin portions further comprises an opening extending through said one of said compliant pin portions and defining curved inner surfaces of said beam portions opposite said outer surfaces, said inner surfaces being presented facing each other.

6. The apparatus recited in claim 4, wherein portions of said outer surfaces of said beam portions define central interface portions of each of said beam portions, each of said interface portions including an interface surface formed on said outer surfaces of said beam portions and facing away from each other.

7. The apparatus recited in claim 6, wherein said interface surfaces provide said frictional engagement with the side wall of the through-hole.

8. The apparatus recited in claim 4, wherein said apparatus is free from means for connecting said apparatus to said printed circuit board other than said compliant pin connectors.

9. The apparatus recited in claim 4, wherein said compliant pin connectors provide a solderless and adhesive-free connection between said apparatus and said printed circuit board.

10. The apparatus recited in claim 1, wherein said apparatus comprises a rocker switch.

11. The apparatus recited in claim 1, further comprising:

third and fourth spaced contacts; and a second rocking contact having third and fourth arms in electrical contact with each other, said second rocking contact being supported for rocking movement in opposite first and second directions, said third arm moving into engagement with said third contact when said second rocking contact rocks in said first direction, said fourth arm moving into engagement with said fourth contact when said second rocking contact rocks in said second direction;

said actuator being pivotable to effectuate rocking movement of said second rocking contact in said first and second directions, said third and fourth contacts each comprising a terminal for helping to mount said apparatus, said terminals each comprising a compliant pin connector.

12. The apparatus recited in claim 11, further comprising a fifth contact maintained in continuous engagement with said rocking contact and a sixth contact maintained in continuous engagement with said second rocking contact;

said rocking contact providing electrical contact between said first and fifth contacts when said first arm moves into engagement with said first contact, said rocking contact providing electrical contact between said second and fifth contacts when said second arm moves into engagement with said second contact, said fifth contact comprising a terminal for helping to mount said apparatus, said terminal comprising a compliant pin connector;

said second rocking contact providing electrical contact between said third and sixth contacts when said third arm moves into engagement with said third contact, said second rocking contact providing electrical contact between said fourth and sixth contacts when said fourth arm moves into engagement with said fourth contact, said sixth contact comprising a terminal for helping to mount said apparatus, said terminal comprising a compliant pin connector.

13. Apparatus comprising:

an electric vehicle window motor operable in first and second rotational directions;

a printed circuit board for delivering electrical signals to the electric motor to cause the electric motor to rotate in the first and second rotational directions;

a rocker switch operable to switch electrical signals to the electric motor via the printed circuit board; and means for providing a solderless electrical connection of the rocker switch to the printed circuit board, said means consisting essentially of compliant pin connectors of the rocker switch.

* * * * *